US010344445B2

(12) United States Patent
Du et al.

(10) Patent No.: US 10,344,445 B2
(45) Date of Patent: Jul. 9, 2019

(54) PREFABRICATED AND FLEXIBLE EARTHQUAKE-RESISTANT SELF-RESETTING STRUCTURE ASSOCIATED WITH A SUBWAY STATION

(71) Applicant: Beijing University of Technology, Beijing (CN)

(72) Inventors: Xiuli Du, Beijing (CN); Hongtao Liu, Beijing (CN); Chengshun Xu, Beijing (CN); Zili Wang, Beijing (CN)

(73) Assignee: Beijing University of Technology, Beijing (CN)

( * ) Notice: Subject to any disclaimer, the term of this patent is extended or adjusted under 35 U.S.C. 154(b) by 0 days.

(21) Appl. No.: 15/566,629

(22) PCT Filed: Feb. 22, 2017

(86) PCT No.: PCT/CN2017/074349
§ 371 (c)(1),
(2) Date: Oct. 13, 2017

(87) PCT Pub. No.: WO2018/072366
PCT Pub. Date: Apr. 26, 2018

(65) Prior Publication Data

US 2019/0048554 A1 Feb. 14, 2019

(30) Foreign Application Priority Data

Oct. 20, 2016 (CN) ..... 2016 1 0916450

(51) Int. Cl.
*E04B 1/98* (2006.01)
*E02D 29/00* (2006.01)
(Continued)

(52) U.S. Cl.
CPC ..... *E02D 29/04* (2013.01); *E02D 29/045* (2013.01); *E04B 1/98* (2013.01); *E04H 9/021* (2013.01); *E04H 9/027* (2013.01)

(58) Field of Classification Search
CPC ..... E02D 29/04; E02D 29/045; E04B 1/98; E04H 9/021; E04H 9/027
See application file for complete search history.

(56) References Cited

U.S. PATENT DOCUMENTS 3,528,208 A * 9/1970 Sugawa ..... E01D 19/04 14/73.1
4,574,540 A * 3/1986 Shiau ..... E02D 27/34 52/167.8

(Continued)

*Primary Examiner* — Paola Agudelo
(74) *Attorney, Agent, or Firm* — Zhihua Han

(57) ABSTRACT

The present disclosure discloses a self-reset flexible earthquake-resistant system of the prefabricated subway station, comprising prefabricated component prestressed tendon, waterproof rubber, and rubber bearing. The main structure of station is built by connection between prestressed tendon and prefabricated component, it changes the connection methods of connection node from consolidation joint to hinged joint which makes the subway station into a flexible system, while at the same time, self-reset function is realized by prestressed tendon; "T" and "Γ" system is combined with rubber waterproof tape, and rubber bearing which is installed in connection site of prefabricated component, multi-protection measures of waterproof is realized, earthquake-resistant effect is also realized. Connection problem with the prefabricated component can be solved by the self-reset flexible earthquake-resistant system of the prefabricated subway station; underground station structure is changed into the flexible system through releasing bending moment in connection site of the prefabricated component, deforming ability of subway station is improved, the earthquake-resistant ability of underground subway station is improved.

8 Claims, 9 Drawing Sheets

(51) Int. Cl.
*E04H 9/02* (2006.01)
*E02D 29/045* (2006.01)

(56) References Cited

U.S. PATENT DOCUMENTS

| | | | | | |
|---|---|---|---|---|---|
| 4,735,234 | A * | 4/1988 | Matiere | E02D 29/045 | 138/100 |
| 5,944,453 | A * | 8/1999 | Gryba | E02D 29/045 | 405/229 |
| 2003/0233798 | A1* | 12/2003 | Berkey | E02D 27/02 | 52/223.7 |
| 2012/0180423 | A1* | 7/2012 | Avila | E04B 1/4157 | 52/700 |
| 2015/0322671 | A1* | 11/2015 | Lichtenfeld | E04B 1/26 | 52/167.1 |
| 2015/0330095 | A1* | 11/2015 | Kurosawa | E04C 5/012 | 52/741.3 |
| 2016/0258161 | A1* | 9/2016 | Imai | E04B 1/38 | |
| 2016/0289951 | A1* | 10/2016 | Hooker | E04B 1/36 | |
| 2017/0342834 | A1* | 11/2017 | Thomson | E21D 9/005 | |
| 2018/0127966 | A1* | 5/2018 | Kurosawa | E04B 1/185 | |

* cited by examiner

PREFABRICATED AND FLEXIBLE EARTHQUAKE-RESISTANT SELF-RESETTING STRUCTURE ASSOCIATED WITH A SUBWAY STATION

CROSS-REFERENCE TO RELATED APPLICATION

This application is a national stage application of International application number PCT/CN2017/074349, filed Feb. 22, 2017, titled "A prefabricated and flexible earthquake-resistant self-resetting structure associated with a subway station," which claims the priority benefit of Chinese Patent Application No. 201610916450.4, filed on Oct. 20, 2016, which is hereby incorporated by reference in its entirety.

TECHNICAL FIELD

The present disclosure belongs to the area of an earthquake-resistant system of a prefabricated subway station, especially including a self-reset flexible earthquake-resistant system of the prefabricated subway station, using prestressed tendon to connect with the prefabricated component to assemble a self-reset flexible earthquake-resistant system of the prefabricated subway station.

BACKGROUND

Conflicts of population, source, environment, and space become more and more serious. Thus, developing the underground system is an important strategy to overcome this conflict. However, the subway station is influenced severely by seismic action, the earthquake-resistant problem of underground system is not appreciated enough for a long time which leads to construction type, design schema, and theory that are developed slowly. With the aggravation of underground seismic hazard, underground earthquake-resistant system designing must be acknowledged by special review. Therefore, it is important to improve the earthquake-resistant ability of the underground system. Based on seismic hazard and destruction mechanism, the subway station is restrained by surrounding soil, while at the same time, it is forced by vertical inertia force of overlying soil, stress components of the subway station are forced by pressing, bending and shearing at the same time which leads to structure destruction. The fabricated structure is energy saving and environment protecting, the fabricated structure used in the underground system is also a developing trend. In current technology, the connection between prefabricated structure uses sleeve grouting method which is called consolidation; this connection method makes structural stiffness changing discordantly, and the earthquake-resistant ability of artifacts is lower. While at the same time its waterproof ability is influenced, it leads to reinforcement corrosion, the durability of underground system is lower.

SUMMARY

To overcome the imperfection of current subway station earthquake-resistant technology, the present disclosure discloses a self-reset flexible earthquake-resistant system of the prefabricated subway station. The earthquake-resistant ability of subway station is improved based on better assembly structure, a problem such as components connection and waterproof in connection site is solved. Combining prefabricated component, prestressed tendon, and earthquake-resistant waterproof system effectively to make fabricated subway station become a flexible waterproof system which is anti-seismic.

To achieve the target mentioned above, the present disclosure uses technical schema below.

A self-reset flexible earthquake-resistant system of the prefabricated subway station is comprising: prefabricated top slab, prefabricated side wall, prefabricated middle slab, prefabricated bottom slab, prefabricated middle column, prestressed tendon, waterproof adhesive tape, rubber bearing, waterproof adhesive tape and large deformation rubber bearing are installed on connection site between prefabricated top slab and prefabricated side wall, waterproof adhesive tape, and large deformation rubber bearing are installed on connection site between prefabricated side wall and prefabricated middle slab waterproof adhesive tape and large deformation rubber bearing are installed on connection site between prefabricated side wall and prefabricated bottom slab, large deformation rubber bearing is installed on connection site between prefabricated top slab and prefabricated middle column, large deformation rubber bearing is installed on connection site between prefabricated middle slab and prefabricated middle column, large deformation rubber bearing is installed on connection site between prefabricated bottom slab and prefabricated middle column; prestressed tendon is used for connecting prefabricated side wall, prefabricated middle slab prefabricated bottom slab, prefabricated middle column with waterproof adhesive tape and large deformation rubber bearing, and applying prestress to keep large deformation rubber bearing under compression state to reach waterproof effect, waterproof adhesive tape is compressed by lateral pressure which makes the subway station to form self-reset flexible structure.

Waterproof adhesive tape and large deformation rubber bearing (8) is combined to form waterproof damping member with the shape of "T" and "⊓."

The prefabricated side wall is connected by both rows prestressed tendon and applies prestress.

The prefabricated middle column is connected by single row prestressed tendon and applies prestress.

Steel slab inner large deformation rubber bearing is fully packed by rubber, the thickness of outermost rubber is no less than 5 mm.

Prestressed reinforcement channels are installed inner prefabricated top slab, prefabricated side wall, prefabricated middle slab, prefabricated bottom slab, prefabricated middle column, the diameter of channel matches with the diameter of the prestressed tendon, the height of prestressed reinforcement channels of the prefabricated side wall to juncture is ⅙ of waterproof adhesive tape.

Many detection pipelines are vertically set on both ends of prefabricated side wall along the station; detection pipeline belongs to the range of waterproof adhesive tape.

Detection pipeline is set with the direction of inclined downwards.

BENEFICIAL EFFECT OF THE PRESENT DISCLOSURE

The self-reset flexible earthquake-resistant system is constructed by connecting prestressed tendon with the prefabricated component. It solves the problem of prefabricated component connection, while at the same time, component connection site is simplified as a flexible hinged joint. Under earthquake loading effect, the bending moment in connection site is released which lower the underground system damage caused by the seismic effect. Moreover, the method connecting prestressed tendon with a prefabricated component can increase construction efficiency, it is better for construction in winter in the north.

The present disclosure uses prestressed tendon connects with the prefabricated component. Subway station self-reset is realized based on prestressing, upper soil and structure self-weight.

The present disclosure combines traditional waterproof rubber with large deformation rubber bearing. It not only meets the waterproof requirement of traditional materials but also reaches the requirement of earthquake-resistant effect. The inner wall of the waterproof bearing is set in the shape of the crescent moon, extruding waterproof adhesive tape and component based on external soil pressure. It is used as the first waterproof effect. Rubber bearing between prefabricated components is extruding vertically by self-weight and prestress which is used as the second waterproof effect. Rust-resisting material outside the prestress tendon is the third defensive line of reinforcement corrosion. Detecting osmosis of underground water through the reserved channel, it is convenient for grouting, and it remedies the low durability of rubber.

The present disclosure uses hinged joint connection based on connecting prestress tendon with large deformation rubber bearing instead traditional connection ways (consolidation connection of middle column, top slab, bottom slab and middle slab), it decreases deformation of the middle column without changing the bearing capacity, the middle column earthquake-resistant ability is improved.

The present disclosure provides reliable connection ways for prefabricated component through the connection between prestress tendon and station prefabricated component; it realizes self-reset and earthquake-resistant of the underground subway station, the earthquake-resistant performance of subway station is improved.

DETAILED DESCRIPTION OF THE PREFERRED EMBODIMENTS

Figure 1:
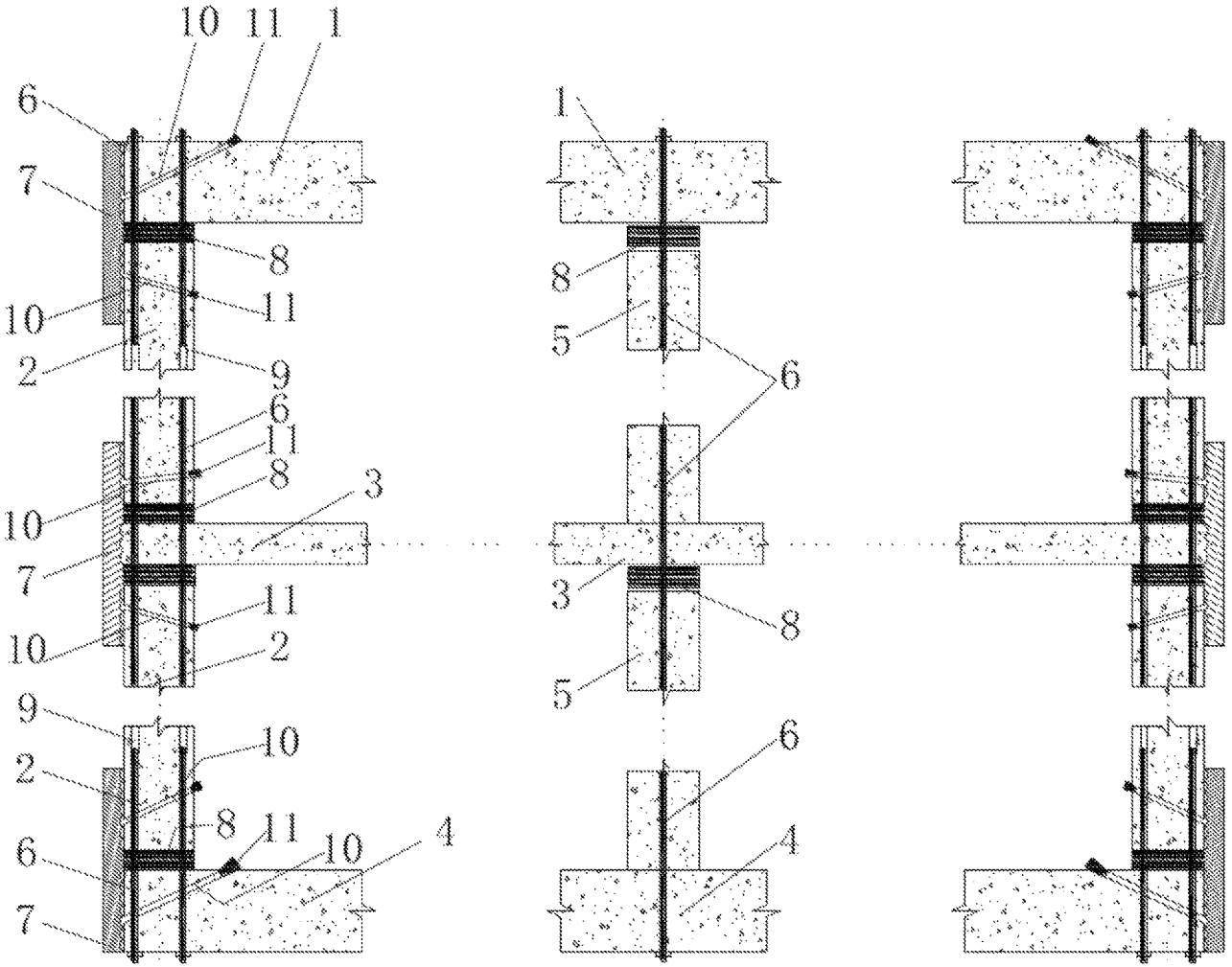
FIG. 1: structure diagram of the self-reset flexible earthquake-resistant system of the prefabricated subway station.
Figure 2A:
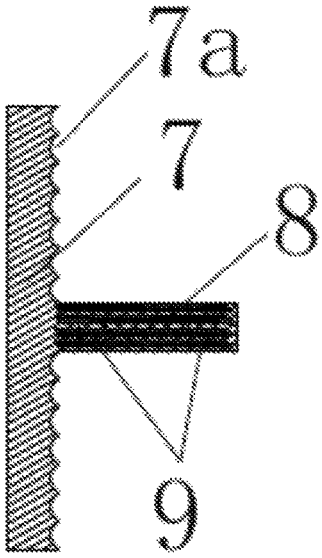
FIG. 2: waterproof "T" diagram of the self-reset prefabricated subway station.
Figure 2B:
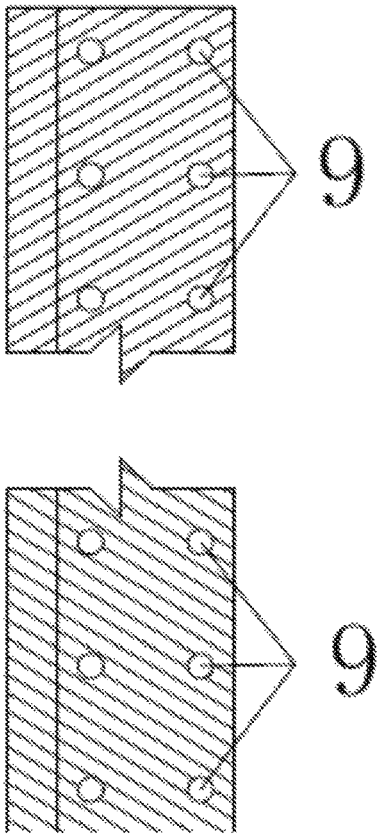
Figure 3A:
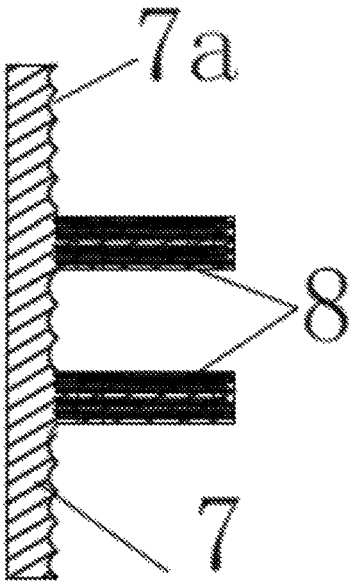
FIG. 3: waterproof "Π" diagram of the self-reset prefabricated subway station.
Figure 3B:
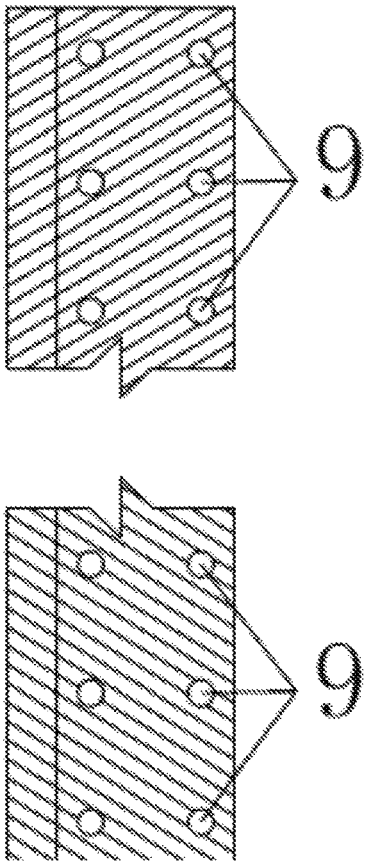
Figure 4:
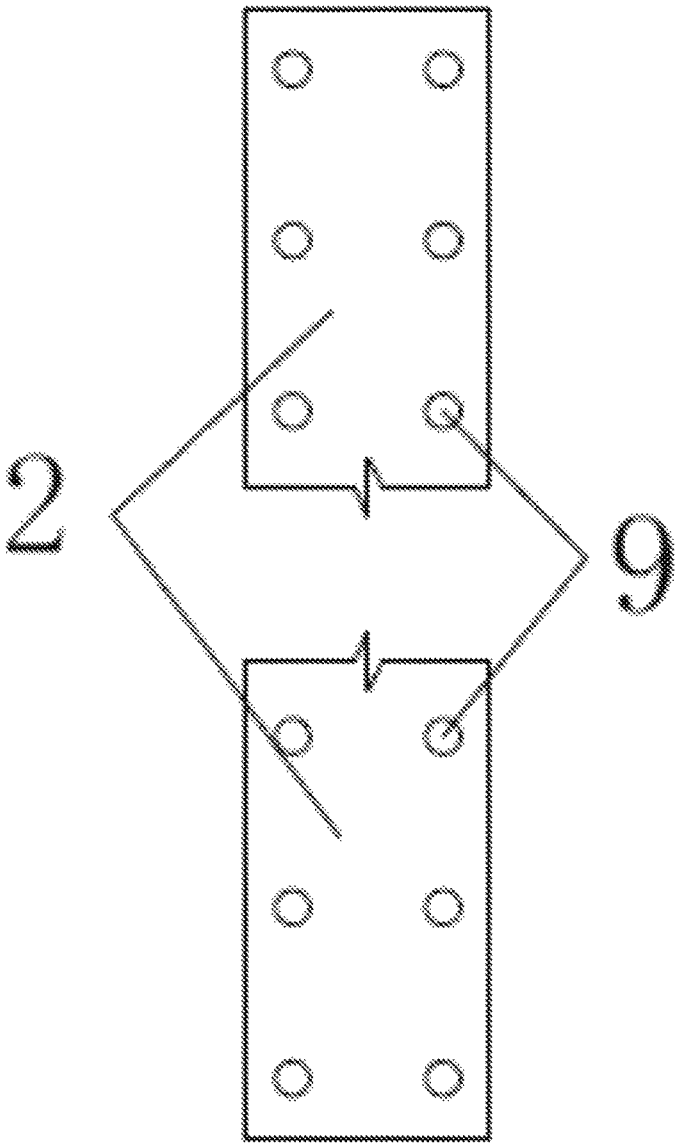
FIG. 4: top view of the prefabricated side wall.
Figure 5:
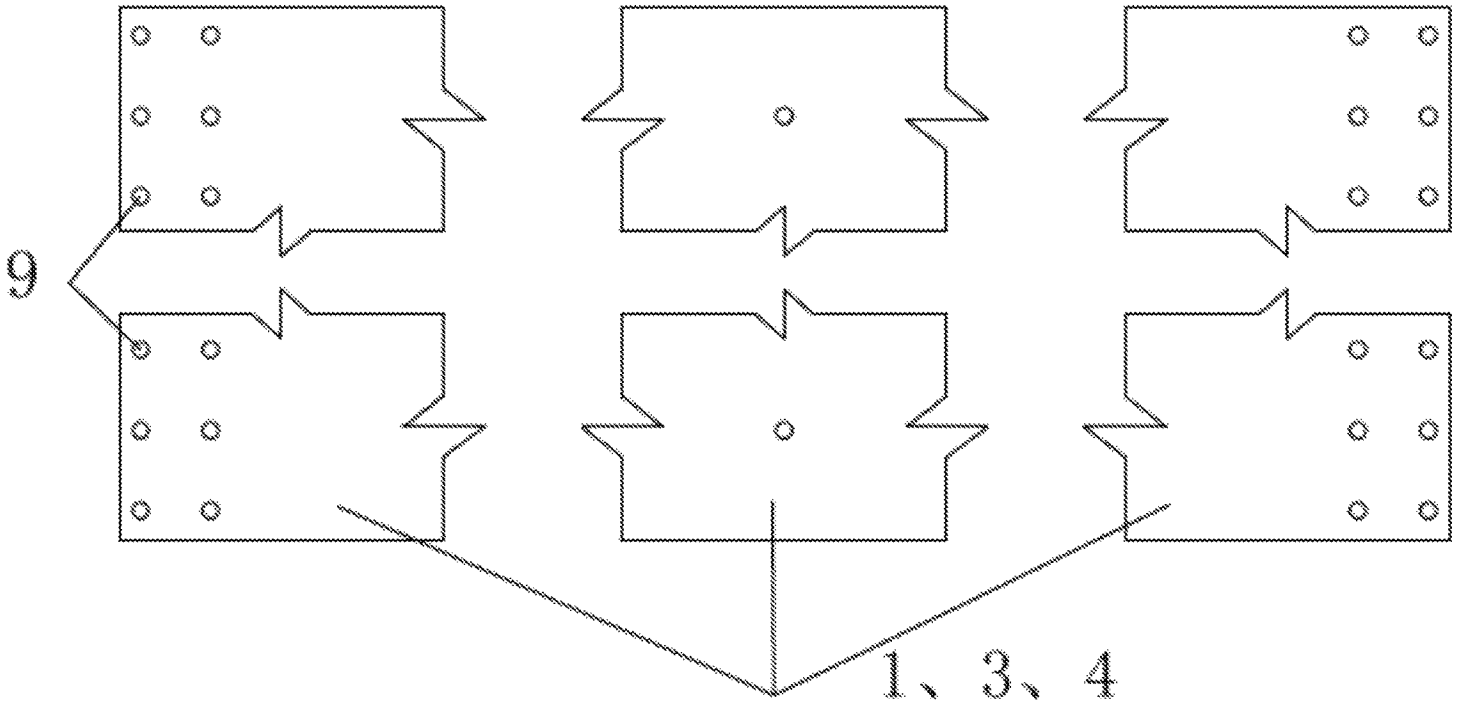
FIG. 5: top view of prefabricated middle column, top slab, middle slab, and bottom slab.
Figure 6:
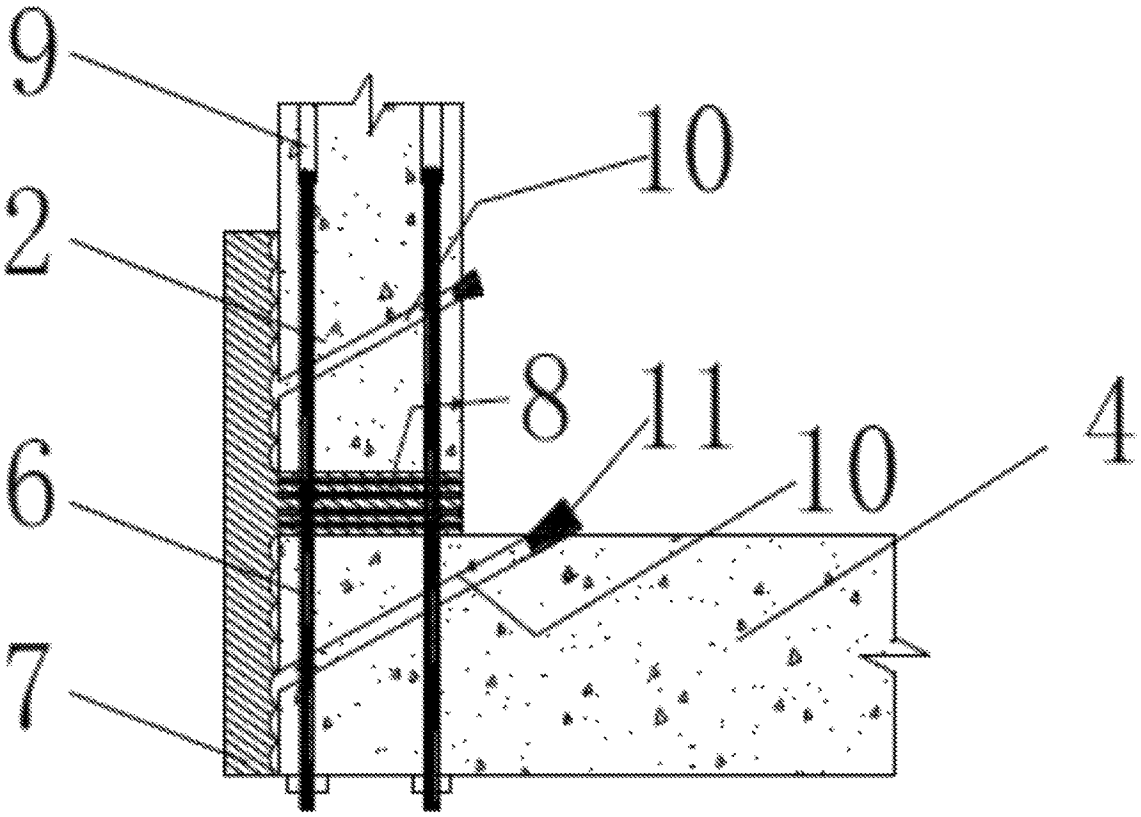
FIG. 6: node diagram of the side wall and the bottom slab of the self-reset prefabricated subway station.
Figure 7:
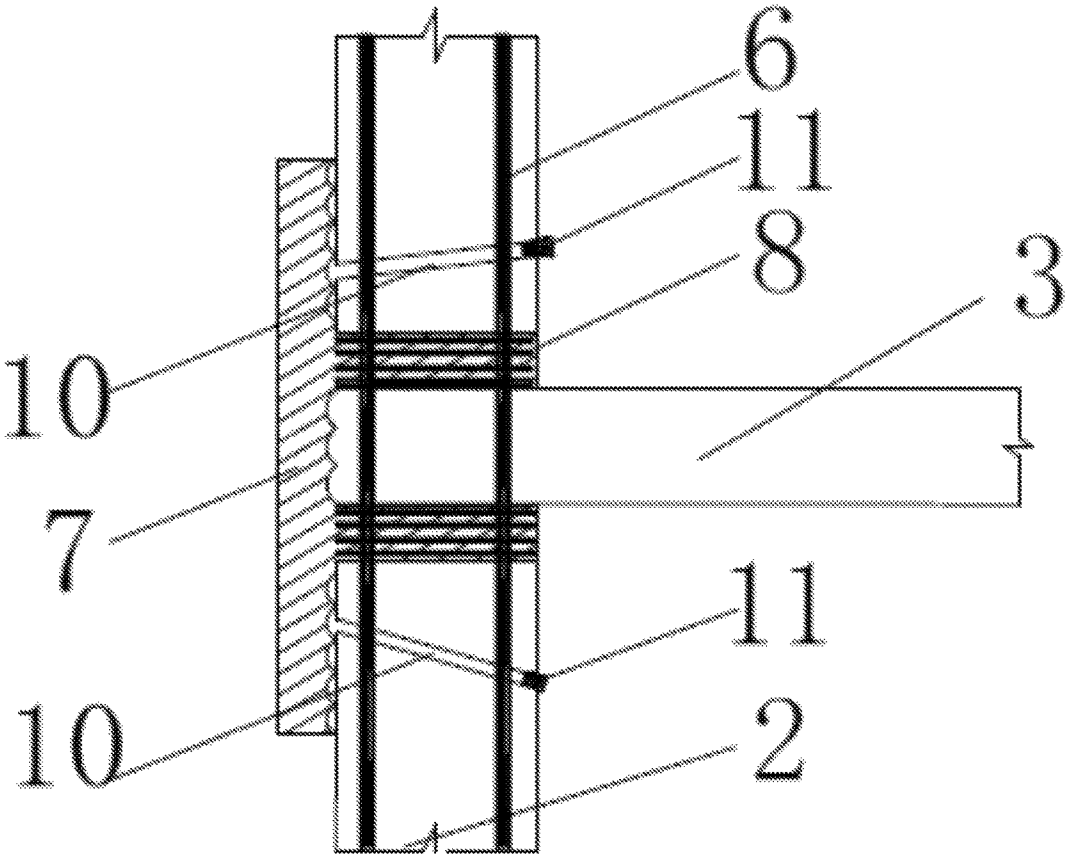
FIG. 7: node diagram of the side wall and the middle slab of the self-reset prefabricated subway station.
Figure 8:
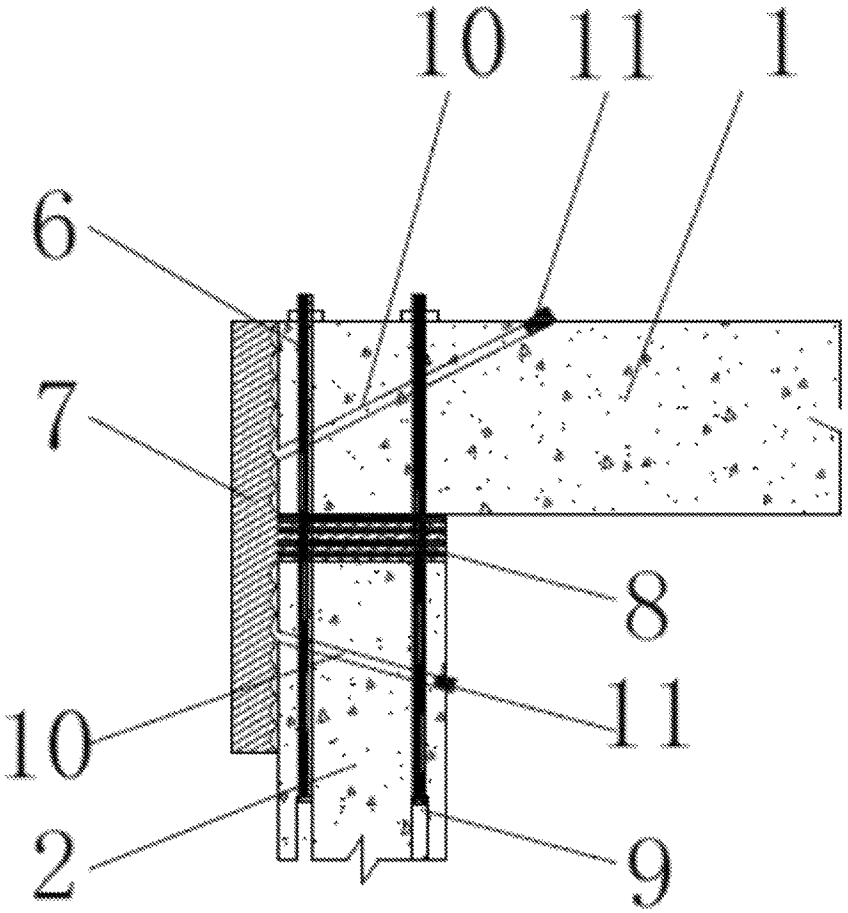
FIG. 8: node diagram of the side wall and the top slab of the self-reset prefabricated subway station.
Figure 9:
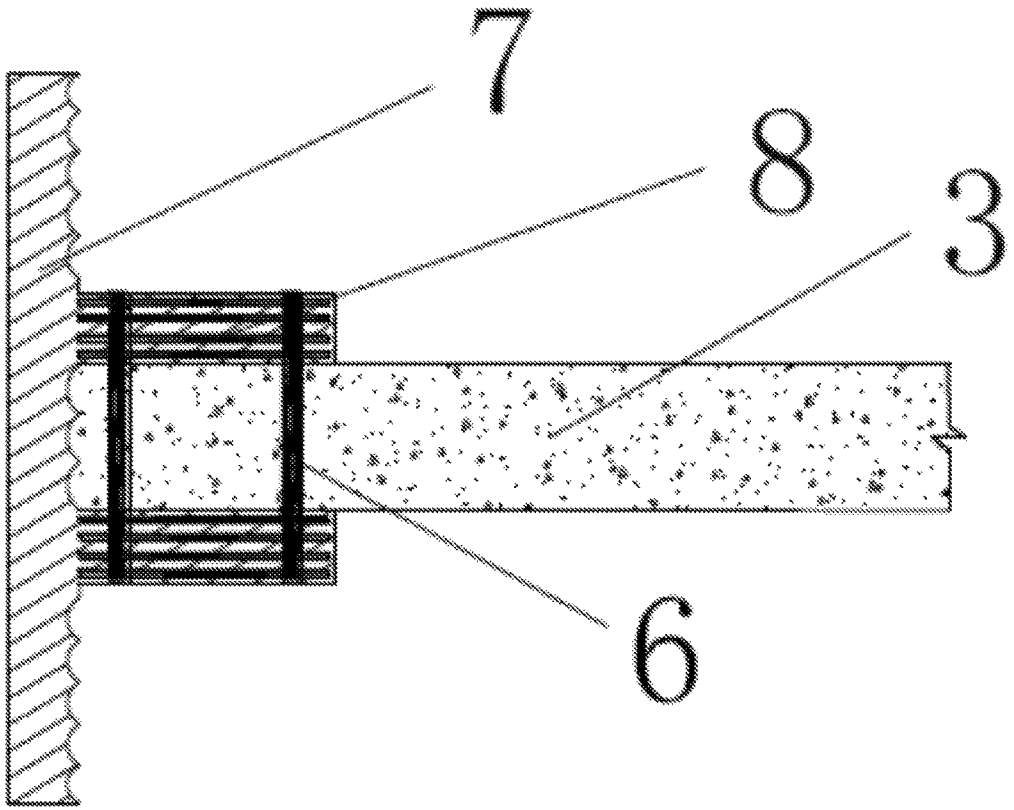
FIG. 9: location diagram of waterproof adhesive tape and large deformation rubber bearing of the self-reset prefabricated subway station. 1—prefabricated top slab, 2—prefabricated side wall, 3—prefabricated middle slab, 4—prefabricated bottom slab, 5—prefabricated middle column, 6—prestressed tendon, 7—waterproof adhesive tape, 8—rubber bearing, 9—prestressed reinforcement channels, 10—detection pipeline, and 11—underground water detection device and packer.

As shown in FIGS. 1-9, the present disclosure discloses a self-reset flexible earthquake-resistant system of prefabricated subway station, self-reset earthquake-resistant prefabricated subway station system is built by connecting prestress tendon with large deformation rubber bearing, comprising: prefabricated component, prestressed tendon (6), waterproof rubber (7) and rubber bearing (8); prefabricated component including: prefabricated top slab (1), prefabricated side wall (2), prefabricated middle slab (3), prefabricated bottom slab (4), and prefabricated middle column (5).

Prefabricated components mentioned above are: vertical prestressed reinforcement channels (9) preset inner prefabricated component which is depth-optimized based on underground system using function and structure style, many detection pipelines (10) is set horizontally and aslant with different height on top and bottom of prefabricated side wall to detect underground water osmosis, grouting process can be finished in later period to remedy the low durability of rubber material.

Prestressed tendon (6) is made of steel strand with high-intensity, and high-tenacity, rust-resisting material is painted outside. Using prestressed tendon passes through the component from bottom slab to top slab successively with a certain tensioning force. This kind of connection will release the bending moment in connection site which makes the structure compatible deformed with surrounding soil; the whole structure is self-reset under the effect of the tension on the prestressed tendon.

Connection problem with the prefabricated component is solved perfectly through prestressed tendon (6) mentioned above, the deformability of the structure is improved by using unbonded prestressed tendon. Waterproof rubber in connection site can be divided into two types, "T" shape waterproof system is used in commissure between side wall and top slab or bottom slab, "Π" shape waterproof system is used in commissure between side wall and middle slab, waterproof adhesive tape is set in the shape of crescent moon, waterproof rubber is compressed tightly under outside pressure.

Waterproof rubber (7) in commissure is a waterproof system in different shape and earthquake-resistant structure of component connection. Waterproof rubber is used outside the side wall; steel slab is added inner rubber bearing, rubber thickness of the outermost is no less than 5 mm, waterproof rubber and large deformation rubber bearing is combined. Large deformation and waterproof can be realized at the same time.

Large deformation rubber bearing (8) is slab bearing made of rubber, the connection between large deformation rubber bearing, middle column and station top and middle slab. The earthquake-resistant ability of middle column is improved.

Based on the advantages of prefabricated structure and combines underground seismic hazard, connection drawback of the prefabricated structure is remedied. Using prefabricated tendon to connect component, waterproof rubber is combined with large deformation rubber bearing, the bending moment in connection site is released. It plays the earthquake-resistant role during an earthquake, while at the same time, it has a self-reset function.

Next, the preferred embodiments will be described in more details accompanied with FIG. 1-9.

Based on the specific function of the station, rational design and deeply analyze the stress form and deep optimization of the prefabricated component.

Prestressed reinforcement channels (9) is preset in the prefabricated component. Embodiments here preset detection pipeline (10) horizontally, finish installation of prefabricated bottom slab (4) and installation of prestressed tendon (6) of anchor foundation slab; while at the same time, finish installation of waterproof adhesive tape (7) and large deformation rubber bearing (8), then, finish installation of the prefabricated side wall. The embodiments immobilize waterproof adhesive tape (7), large deformation rubber bearing (8) and prefabricated middle slab (3), process integral hoisting and using prestressed tendon (6) for connection, and then, install top prefabricated side wall (2), waterproof adhesive tape (7) and large deformation rubber bearing (8) on the top of the station and prefabricated top slab (1). Middle column is installed in the same way; external force is provided by jack, and it forces prestressed tendon (6) with a certain intensity to keep large deformation rubber bearing (8) in commissure under pressing state.

Waterproof adhesive tape (7) outside the side wall is pressed through external soil pressure which makes waterproof adhesive tape (7) contacts side wall closely. Underground water detection device is installed in detection pipeline (10).

After finishing the installation of the whole structure, installation of other structures is processed.

The present disclosure discloses a self-reset flexible earthquake-resistant system of prefabricated subway station based on underground seismic hazard and underground damage mechanism. Prefabricated component after specialized design and deep optimization, installation accuracy is ensured. Waterproof adhesive tape (7) and large deformation rubber bearing (8) are integrated; it not only meets the waterproof requirement of traditional materials but also reaches the requirement of earthquake-resistant effect. Prestress and deformation bearing connection are used in prefabricated connection site. Node bending moment is released, which makes structure system into the flexible system, compatible deforming with surrounding soil, and the earthquake-resistant ability of structure is improved; while at the same time, prestressed tendon makes the structure have a self-resetting function.

What is claimed is:

1. A prefabricated and flexible earthquake-resistant self-resetting rectangular structure associated with a subway station, the structure comprising:

a plurality of prefabricated top slabs, a plurality of prefabricated side walls, a plurality of prefabricated middle slabs, a plurality of prefabricated bottom slabs, a plurality of middle columns, a plurality of prestressed tendons, a plurality of waterproof adhesive tapes, a plurality of rubber bearings, and a plurality of prestressed reinforcement channels installed within the slabs and the middle columns, wherein:

a waterproof adhesive tape and a rubber bearing are installed on a connection site between a prefabricated top slab and a prefabricated side wall, wherein the prefabricated top slab and the prefabricated side wall are perpendicular to each other;

a waterproof adhesive tape and a rubber bearing are installed on a connection site between a prefabricated side wall and a prefabricated middle slab, wherein the prefabricated middle slab and the prefabricated side wall are perpendicular to each other;

a waterproof adhesive tape and a rubber bearing are installed on a connection site between a prefabricated side wall and a prefabricated bottom slab, wherein the prefabricated side wall and the prefabricated bottom slab are perpendicular to each other;

a rubber bearing is installed on a connection site between a prefabricated top slab and a prefabricated middle column, wherein the prefabricated top slab and the prefabricated middle column are perpendicular to each other;

a rubber bearing is installed on a connection site between a prefabricated middle slab and a prefabricated middle column;

a rubber bearing is installed on a connection site between a prefabricated bottom slab and a prefabricated middle column;

the prestressed tendons are installed within the prestressed reinforcement channels and configured to connect and transfer stress to the prefabricated side walls, the prefabricated top slab, the prefabricated middle slab, the prefabricated bottom slab, and the prefabricated middle column;

the prefabricated top slab, the prefabricated middle slab, the prefabricated bottom slab, and the prefabricated middle column are connected with the waterproof adhesive tape and the rubber bearing, and are configured to add prestress to keep the rubber bearings deformed under a compression state to reach waterproof effects, and the waterproof adhesive tape is compressed by lateral pressure to make the subway station to form the self-resetting structure.

2. The structure of claim 1, wherein the waterproof adhesive tape and the deformed rubber bearing are combined to form a waterproof damping member with a shape of "T" or "Π."

3. The structure of claim 1, wherein the prefabricated side walls are connected by two rows of the prestressed tendons configured to transfer stress to the prefabricated side walls.

4. The structure of claim 1, wherein the prefabricated middle column is connected by a single row of the prestressed tendon configured to transfer stress to the middle column.

5. The structure of claim 1, wherein the rubber bearing comprises an inner steel plate fully covered by rubber, wherein the rubber thickness is no less than 5 mm.

6. The structure of claim 1, wherein a diameter of the prestressed reinforcement channel matches with a diameter of the prestressed tendon.

7. The structure of claim 1, wherein multiple detection pipelines are provided aslant on both ends of the prefabricated side wall along the station, and the detection pipelines are located within a range of the waterproof adhesive tape.

8. The structure of claim 1, wherein the detection pipelines are set to tilt down.

* * * * *